US005678381A

United States Patent [19]

DenAdel

[11] Patent Number: 5,678,381

[45] Date of Patent: Oct. 21, 1997

[54] INSULATED BEAM

[76] Inventor: Duane G. DenAdel, 3727 80th SE., Mercer Island, Wash. 98040

[21] Appl. No.: 344,993

[22] Filed: Nov. 25, 1994

[51] Int. Cl.[6] ..... E04C 3/30

[52] U.S. Cl. ..... 52/730.1; 52/731.2; 52/737.4

[58] Field of Search ..... 52/730.1, 737.1, 52/737.3, 737.4, 738.1, 309.14, 404.2, 404.3, 730.2, 309.7, 309.16, 731.1, 731.2, 731.4, 731.5

[56] References Cited

U.S. PATENT DOCUMENTS

| | | | |
|---|---|---|---|
| 2,790,524 | 4/1957 | Herrschaft | 52/731.4 X |
| 3,327,441 | 6/1967 | Kelly | 52/737.4 X |
| 3,531,901 | 10/1970 | Will, Jr. et al. | 52/731.4 X |
| 3,810,337 | 5/1974 | Pollard | 52/737.4 X |
| 4,580,380 | 4/1986 | Ballard | 52/731.2 X |

*Primary Examiner*—Kien T. Nguyen
*Attorney, Agent, or Firm*—Robert M. Storwick

[57] ABSTRACT

An insulative beam and method for its construction. The insulative beam includes two support channels formed from a sheet metal and a block of a plastic material shaped so that each of the two channels wraps at least partly around the block of plastic material. In some embodiments of the invention, the channels extend longitudinally beyond the block of plastic material. If desired to give additional strength to the ends of the insulative beam, the ends are reinforced with angles or channels that fit at the end of the block of plastic material and the angles or channels are welded to the support channels. In other embodiments, the reinforcement is supplied by vertical ribs formed in the web of the support channels. The location of the vertical ribs can be at the ends of the beam or at other areas that are otherwise weakened. Additional reinforcement can be provided by vertical supports within each of the channels. In a further preferred embodiment, the channels are further reinforced by rectangular tubes that run longitudinally along the corners of the channels. In a still further preferred embodiment, the support beam includes two angles with a rectangular tube placed at the corner of the angle and another rectangular tube attached at the upper end of the angle. To further strength the beam, copies of the beam can be placed together and welded so that they act together.

2 Claims, 7 Drawing Sheets

INSULATED BEAM

TECHNICAL FIELD

The present invention relates to construction materials, and more particularly, to an insulated beam and methods for its construction.

BACKGROUND OF THE INVENTION

A typical beam or truss used in construction is a single length of wood as grown in the forest that has been trimmed to the desired dimensions. While such beams have served for centuries in the construction of homes and other buildings, today's greater demand for heating and cooling efficiency has affected the choice of building materials. Materials having high thermal insulation values are currently being used in construction walls and roofs, but the search for other substitutes is continual.

One area which has not been affected much by this search for thermal efficiency is that of beams that are used for window and door headers and beams that are used to support entire building structures. Some new laminated beams made from recycled or waste forestry products and modern glues and adhesives are used, but they are expensive and heavy. It is still desirable to have a thermally-insulated beam which is light and yet equal in strength to wood beams.

SUMMARY OF THE INVENTION

According to one aspect, the invention is an elongated structural thermally-insulative element for supporting a transverse load. The beam comprises first and second integral elongated load-bearing members and a thermally-insulative member placed between the first and second members so that the first and second members each extend in at least two transverse directions relative to the thermally-insulative member, thereby at least partially enclosing the thermally-insulative member.

In a further aspect, the invention is a method for forming an elongated structural thermally-insulative element for supporting a transverse load. The method includes the steps of a) forming first and second integral elongated load-bearing members and b) forming a thermally-insulative member. The method further includes the step of c) placing the thermally-insulative member between the first and second members so that the first and second members each extend in at least two transverse directions relative to the thermally-insulative member, thereby at least partially enclosing the thermally-insulative member.

DETAILED DESCRIPTION OF THE PREFERRED EMBODIMENT OF THE INVENTION

Figure 1:
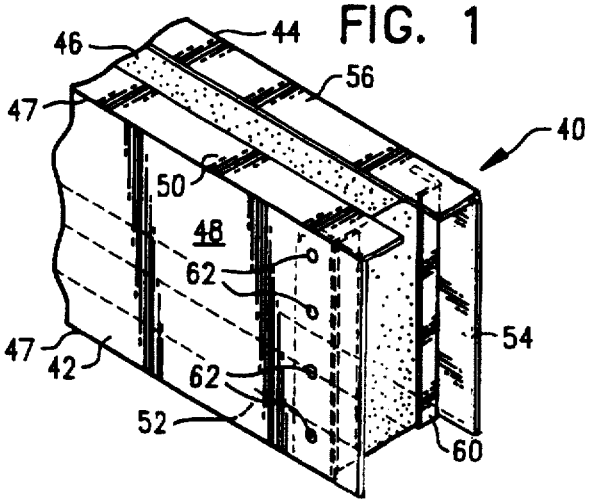
FIG. 1 is a perspective view of a first preferred embodiment of the thermally insulative member of the present invention.
Figure 2:
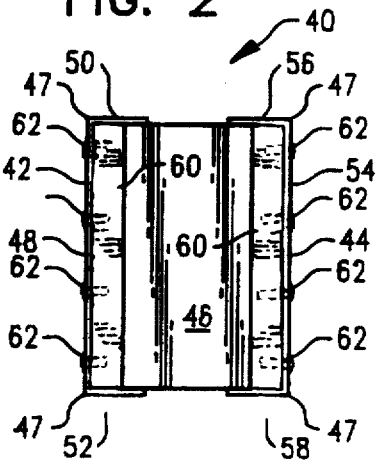
FIG. 2 is a side elevation view of an end of the first preferred embodiment of the thermally-insulative member of the present invention.
Figure 3:
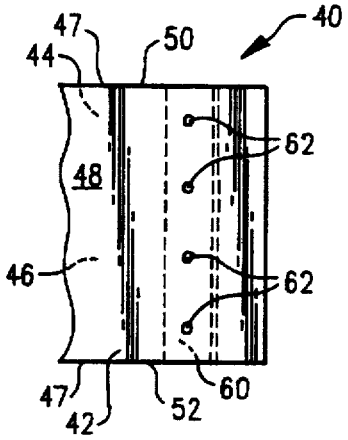
FIG. 3 is a side elevation view of a side of the first preferred embodiment of the thermally-insulative member of the present invention.
Figure 4:
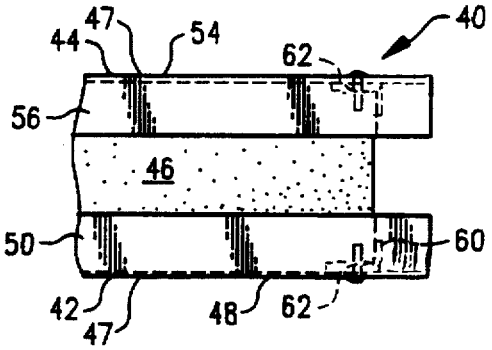
FIG. 4 is a top view of the end of the first preferred embodiment of the thermally-insulative member of the present invention.
Figure 5:
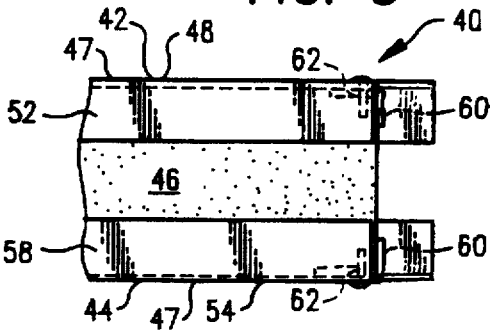
FIG. 5 is a bottom view of the end of the first preferred embodiment of the thermally-insulative member of the present invention.

FIG. 1 is a perspective view of a first preferred embodiment of the thermally-insulative member of the present invention. FIG. 2 is a side elevation view of an end of the first preferred embodiment of the thermally-insulative member of the present invention, and FIG. 3 is a side elevation view of a side of the first preferred embodiment of the thermally-insulative member of the present invention. FIG. 4 is a top view of the end of the first preferred embodiment of the thermally-insulative member of the present invention, and FIG. 5 is a bottom view of the end of the first preferred embodiment of the thermally-insulative member of the present invention. The thermally-insulative member 40 is intended primarily for supporting a dead and live downward vertical compressive loads, such as the weight borne by a truss or by a door or window header in house construction. However, it can also support an upward vertical load or wind or seismic shear or lateral loads to the member 40.

The thermally insulative member 40 includes a first load-bearing member 42, a second load-bearing member 44, and a thermally-insulative member 46. The first and second load-bearing members 42 and 44 are each elongated and made from a single integral piece of material. If the material is a sheet metal, such as galvanized steel or aluminum, the first and second load-bearing members 42 and 44 are formed by properly bending the sheet. A 16 gauge sheet metal has been found suitable for many applications, although other gauges can be chosen as desired. For example, in the case of window and door headers, a 16 gauge sheet metal would be appropriate, while for heavier applications, trusses made from 12 gauge sheet metal and having 24 inch depths or more would be more appropriate. Those skilled in building engineering and the building trades will know to make the proper choices from among these variables. If the material is a formed material, such as fiberglass or carbon fiber composites, the first and second load-bearing members 42 and 44 are shaped properly before their shape is finally set by some further action, such as a thermal or chemical reaction.

The thermally-insulative member 46 is placed between and in contact with the first and second members 42 and 44. The placement is set so that the first and second members 42 and 44 each extend transversely vertical and transversely horizontal relative to the thermally-insulative member 46. The thermally-insulative member 46 is formed from any material having a suitable thermal insulation value. Preformed blocks made from expanded or extruded polystyrene are suitable, although polyethylene, polyisocyanurite and polyurethane are also suitable plastics. In 3.5 inch thicknesses, such plastics have thermal resistance (R–) values of R–22, compared to approximately R–3 for wood having an equal thickness and equivalent strength. Other conventional or non-conventional insulative materials such as light weight concrete or processed volcanic materials such as lava, and even including a mixture of mud and straw are also suitable for some applications.

In the first preferred embodiment shown in FIGS. 1–5, the first and second members 42 and 44 are channels, formed by bending a length of 16 gauge galvanized sheet steel along two parallel lines 47. The first member 42 is a channel that includes a web 48 that extends between an upper leg 50 and a lower leg 52. Preferably the upper leg 50 and the lower leg 52 are equal in length, although they need not necessarily be. Similarly, the second member 42 is a channel that includes a web 54 that extends between an upper leg 56 and a lower leg 58. The second member 42 is a channel that includes a web 48 that extends between an upper leg 50 and a lower leg 52. Preferably the upper leg 56 and the lower leg 58 are equal in length, although they need not necessarily be. In the thermally-insulative member 40, the web 48 is parallel to the web 54, and the upper legs 50 and 56 and the lower legs 52 and 58, respectively extend toward one another.

The thermally-insulative member 46 is a rectangular solid having a length that is equal, or very nearly equal, to the lengths of the first and second members 42 and 44. The rectangular solid shape of the thermally-insulative member 46 is defined by three pairs of surfaces in the form of parallel rectangles. The two rectangles in one pair of the parallel rectangles are separated vertically and the two rectangles in each of the other pairs of parallel rectangles are separated horizontally, so that the thermally-insulative member 46 has first and second horizontally separated vertical surfaces and two pairs of vertically separated horizontal surfaces. In some forms of the thermally-insulative member 40, the first and second members 42 and 44 extend slightly beyond the length of the thermally-insulative member 46, while in other forms the first and second members 42 and 44 are equal in length to the thermally-insulative member 46. The height of the thermally-insulative member 46 is equal to the vertical separation from the upper legs 50 and 56 to the lower legs 52 and 58, respectively. The width of the thermally-insulative member 46 is greater than the respective sums of the lengths of the upper legs 50 and 56 and of the lower legs 52 and 58. Accordingly, the ends of the upper legs 50 and 56 do not touch and the ends of the lower legs 52 and 58 do not touch. As a result, a portion of the thermally-insulative member 46 is exposed between the two upper legs 50 and 56 and between the two lower legs 52 and 58.

The first and second members 42 and 44 support the load applied to the member 40 and the thermally-insulative member 46 substantially increases the overall thermal insulation value of the member 40. The member 40 can be built in any desired dimensions. However, the vertical height of the member 40 is typically 8, 10 and 12 inches, while the width of the member 40 is typically 3.5 and 5.5 inches. The overall length of the member 40 is typically 30, 40, or more feet in trussing applications, and typically 3 to 8 feet in window and door header applications. Each of the upper and lower legs 50, 52, 56 and 58 are typically 1.5 inches long, although any suitable sizes can be chosen. As shown in FIGS. 1 and 3–5, the first and second load-bearing members 42 and 44 extend beyond the end of the thermally-insulative member 46. This configuration is suitable in window and door applications, since the amount of extension of the first and second load-bearing members 42 and 44 is typically about 1.5 inches in the longitudinal direction. This gives the extension the right size to correctly receive a vertical king stud, which may be fastened to the extension portion of the first and second load-bearing members 42 and 44 with screws or other suitable conventional fasteners. A cripple (or trimmer) stud may be placed under the member 40 and adjacent the king stud to further support the member 40. In some cases, the king stud will extend above the member 40, where it will tie in to the roof or ceiling structure.

While the member 40 is very strong and also thermally-insulative, it may be desirable to increase its strength further. One way of increasing the strength of the member 40 is to reinforce the vertical corners at the ends of the thermally-insulative member 46. In one form of reinforcement, each of the four vertical corners is supported by a length 60 made from a 16 gauge metal angle that extends vertically between corresponding upper and lower legs 50 and 52 (56 and 58) and contacts the web 48 (54). The length 60 is attached to the contacting web 48 (54) by means of fasteners 62, such as screws. Alternatively, the length 60 is attached to the contacting web 48 (54) by a series of stitch welds (say, 0.5 inch long and spaced by 3 inches).

Figure 6:
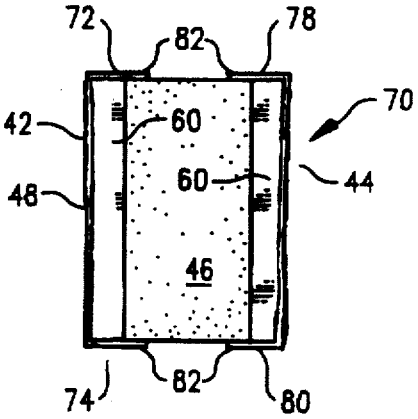
FIG. 6 is a side elevation view of an end of a second preferred embodiment of the thermally-insulative member of the present invention.

FIG. 6 is a side elevation view of an end of a second preferred embodiment of the thermally-insulative member of the present invention. The second preferred embodiment of the thermally-insulative member 70 is identical to the first preferred embodiment described in FIGS. 1–5, except that the upper and lower legs 50, 52, 56 and 58 are respectively replaced by upper and lower legs 72, 74, 78 and 80. The upper and lower legs 72, 74, 78 and 80 differ from the upper and lower legs 50, 52, 56 and 58, respectively, by the addition of a small rolled edge 82 on each of the upper and lower legs 72, 74, 78 and 80. The rolled edge 82 adds further strength to the first and second load-bearing members 42 and 44.

Figure 6A:
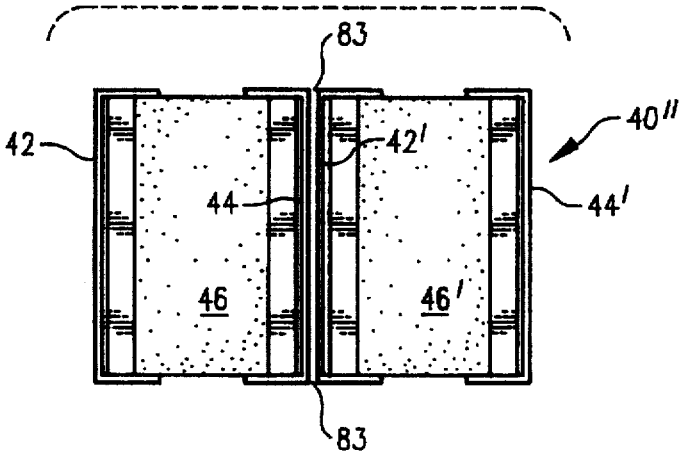
FIG. 6A is a side elevation view of an end of an additional preferred embodiment of the thermally-insulative member of the present invention.

FIG. 6A is a side elevation view of an end of an additional preferred embodiment of the thermally-insulative member of the present invention. In the member 40", two identical copies of a member as shown in FIG. 1–5 are placed side-by-side, so that web 44 is adjacent web 42'. Then the two webs are welded together along seam 83 to form the beam 40".

Figure 7:
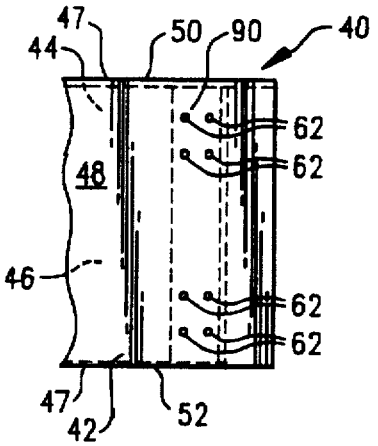
FIG. 7 is a side elevation view of a side of a third preferred embodiment of the thermally-insulative member of the present invention.
Figure 8:
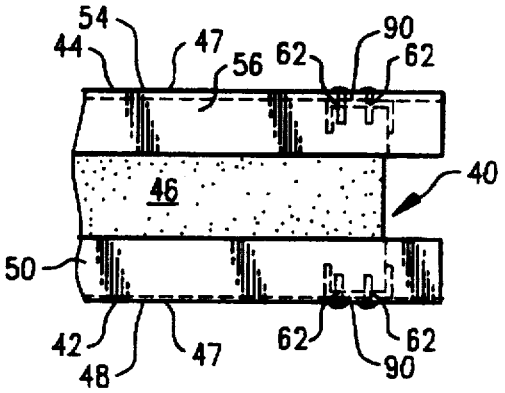
FIG. 8 is a top view of an end of the third preferred embodiment of the thermally-insulative member of the present invention.
Figure 9:
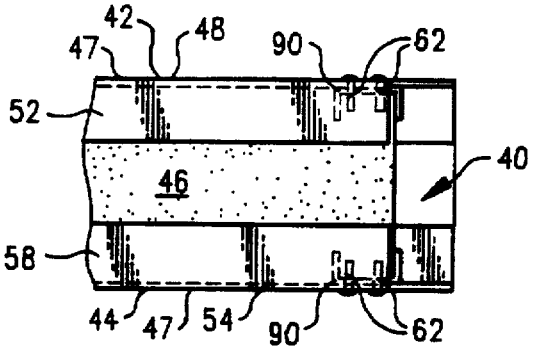
FIG. 9 is a bottom view of the end of the third preferred embodiment of the thermally-insulative member of the present invention.

FIG. 7 is a side elevation view of a side of a third preferred embodiment of the thermally-insulative member of the present invention. FIG. 8 is a top view of an end of the third preferred embodiment of the thermally-insulative member of the present invention, and FIG. 9 is a bottom view of the end of the third preferred embodiment of the thermally-insulative member of the present invention. The third preferred embodiment of the thermally-insulative member 40 of the present invention is substantially the same as the first preferred embodiment of the thermally-insulative member 40 shown in FIGS. 1–5. The third preferred embodiment shows another way of increasing the strength of the member 40 by reinforcing the vertical corners at the ends of the thermally-insulative member 46. In this other form of reinforcement, each of the four vertical corners is supported by a length 90 made from a 16 gauge metal channel that extends vertically between corresponding upper and lower legs 50 and 52 (56 and 58) and contacts the web 48 (54). The length 90 is attached to the contacting web 48 (54) by means of fasteners 62, such a self-tapping sheet metal screws. Alternatively, the length 90 is attached to the contacting web 48 (54) by a series of stitch welds.

Figure 11:
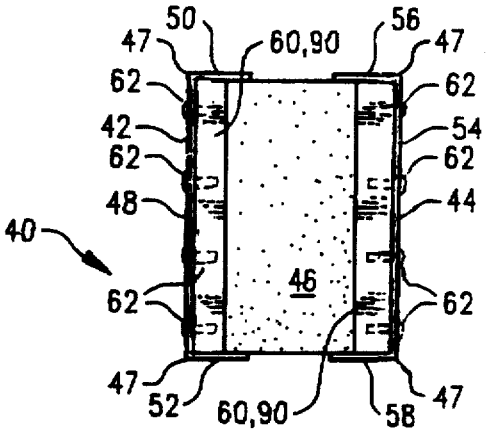
FIG. 11 is a side elevation view of an end of the fourth preferred embodiment of the thermally-insulative member of the present invention.
Figure 10:
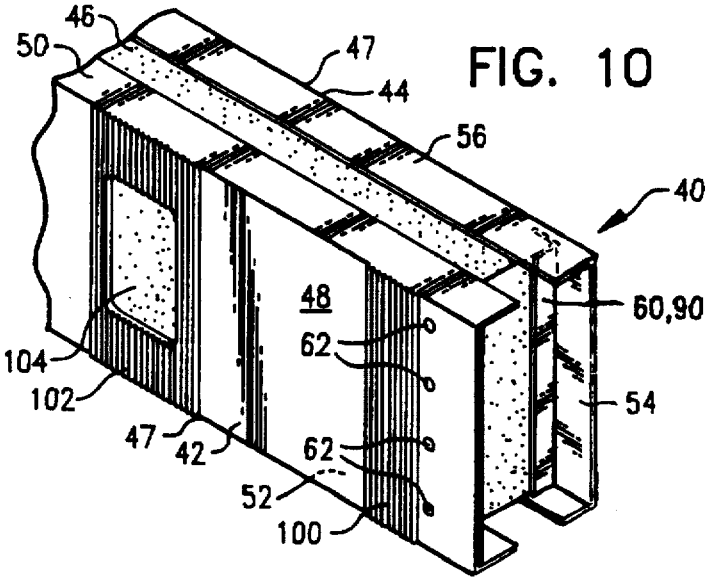
FIG. 10 is a perspective view of a fourth preferred embodiment of the thermally-insulative member of the present invention.
Figure 12:
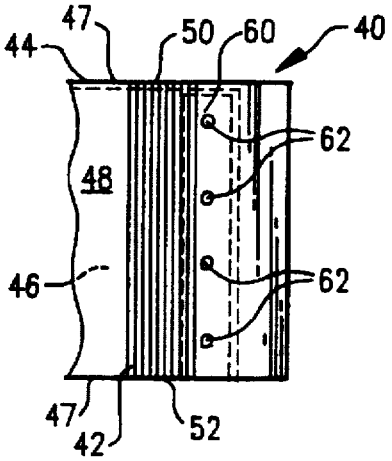
FIG. 12 is a side elevation view of a side of the fourth preferred embodiment of the thermally-insulative member of the present invention.
Figure 13:
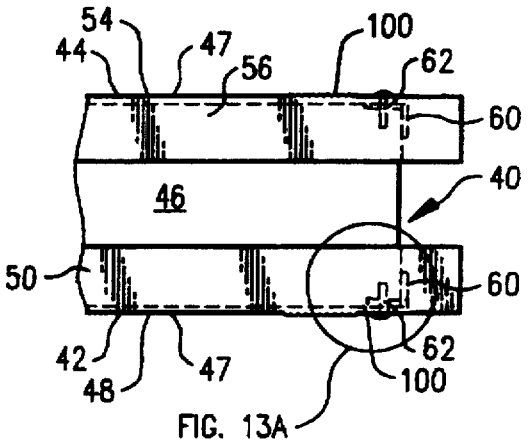
FIG. 13 is a top view of the end of the fourth preferred embodiment of the thermally-insulative member of the present invention.
Figure 14:
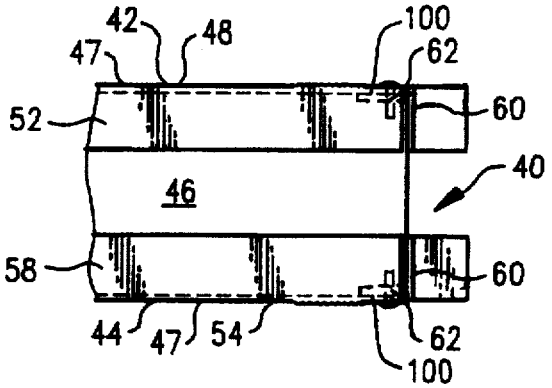
FIG. 14 is a bottom view of the end of the fourth preferred embodiment of the thermally-insulative member of the present invention.
Figure 13A:
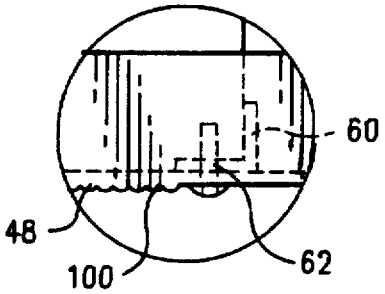
FIG. 13A is a close-up view of a portion of the end of the fourth preferred embodiment shown in FIG. 13.

FIG. 10 is a perspective view of a fourth preferred embodiment of the thermally-insulative member of the present invention. FIG. 11 is a side elevation view of an end of the fourth preferred embodiment of the thermally-insulative member of the present invention, and FIG. 12 is a side elevation view of a side of the fourth preferred embodiment of the thermally-insulative member of the present invention. FIG. 13 is a top view of the end of the fourth preferred embodiment of the thermally-insulative member of the present invention, FIG. 13A is a close-up view of a portion of the end of the fourth preferred embodiment shown in FIG. 13, and FIG. 14 is a bottom view of the end of the fourth preferred embodiment of the thermally-insulative member of the present invention.

The fourth preferred embodiment of the thermally-insulative member 40 of the present invention is substantially the same as the first preferred embodiment of the thermally-insulative member 40 shown in FIGS. 1–5. However, the fourth preferred embodiment shows a further way of increasing the strength of the ends of the member 40—by reinforcing the ends of the first and second load-bearing members 42 and 44. In this further form of reinforcement, each of the two ends of the member 40 is strengthened by a series of vertical ribs 100 formed in the web made from a metal channel that extends vertically between corresponding upper and lower legs 50 and 52 (56 and 58). The vertical ribs 100 are spaced longitudinally approximately every 1 or 2 inches, and each vertical rib 100 is approximately 0.25 to 0.5 inch deep (in the transverse horizontal direction). The thermally-insulative member 46 has grooves cut or formed in those areas corresponding to the parts of the webs 48 and 54 where the vertical ribs 100 will be placed.

Although FIGS. 10, 13, 13A and 14 show that the vertical ribs 100 extend only over that part of the webs 48 and 54 that are in contact with the thermally-insulative member 46, further strengthening is also provided by extending the vertical ribs 100 over the parts of the webs 48 and 54 that extend beyond the thermally-insulative member 46. Of course, the lengths 60 or 90 can be added to the member if still further strengthening is desired. If the lengths 60 or 90 are added, they are attached to the webs 48 and 54 by fasteners 62 and/or stitch welding. The vertical ribs 100 are preferably formed by stamping the webs 48 and 54 either before or after the upper and lower legs 50 and 52 (or 56 and 58) are formed.

Aside from strengthening the ends of the member 40, vertical ribs 102 (similar in structure to the vertical ribs 100) can also be placed near areas of the webs 48 and 54 which are weakened, for example, by the placement of an aperture 104 for providing access between the exterior and interior of the member 40. The thermally-insulative member 46 will have grooves cut or formed in those areas corresponding to the parts of the webs 48 and 54 where the vertical ribs 102 will be placed. The vertical ribs 102 are formed in the webs 48 and 54 either before or after the upper and lower legs 50 and 52 (or 56 and 58) are formed.

Figure 15:
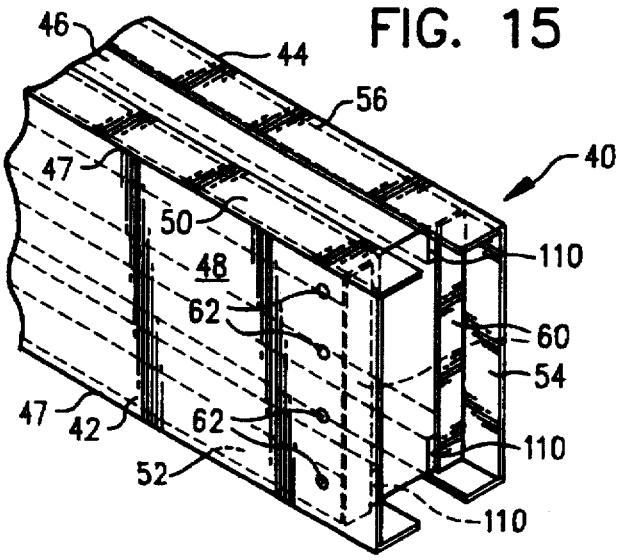
FIG. 15 is a perspective view of a fifth preferred embodiment of the thermally-insulative member of the present invention.
Figure 16:
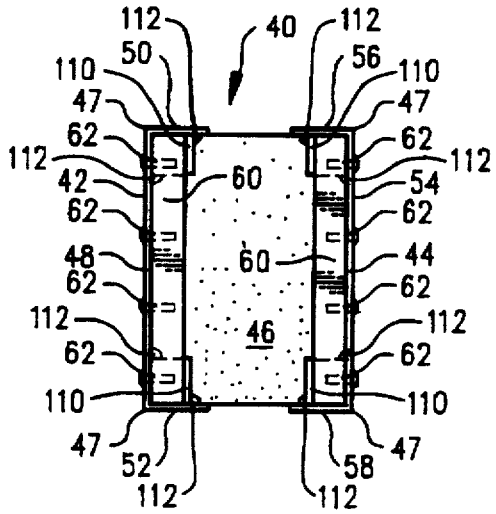
FIG. 16 is a side elevation view of an end of the fifth preferred embodiment of the thermally-insulative member of the present invention.
Figure 17:
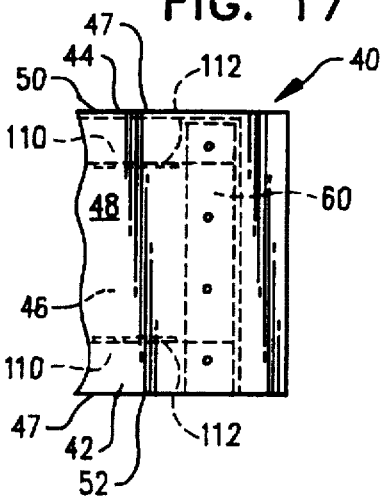
FIG. 17 is a side elevation view of a side of the fifth preferred embodiment of the thermally-insulative member of the present invention.
Figure 18:
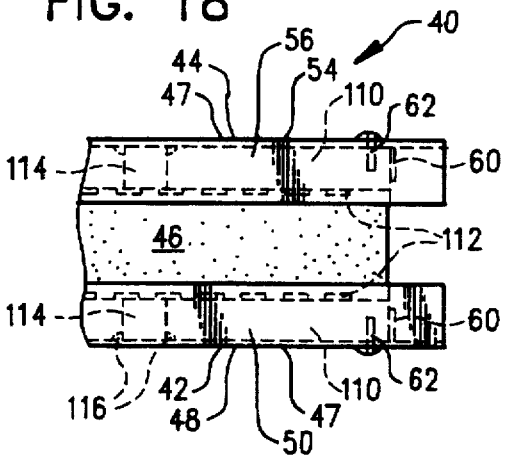
FIG. 18 is a top view of the end of the fifth preferred embodiment of the thermally-insulative member of the present invention.
Figure 19:
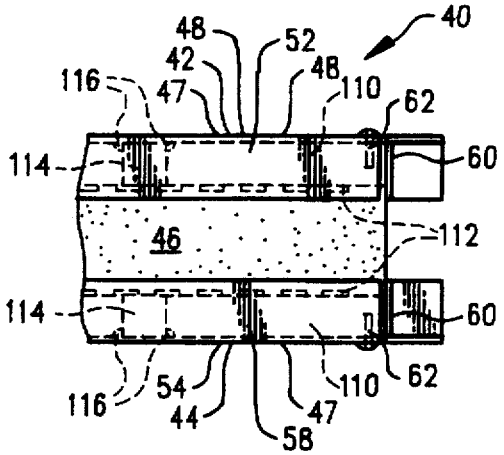
FIG. 19 is a bottom view of the end of the fifth preferred embodiment of the thermally-insulative member of the present invention.
Figure 20:
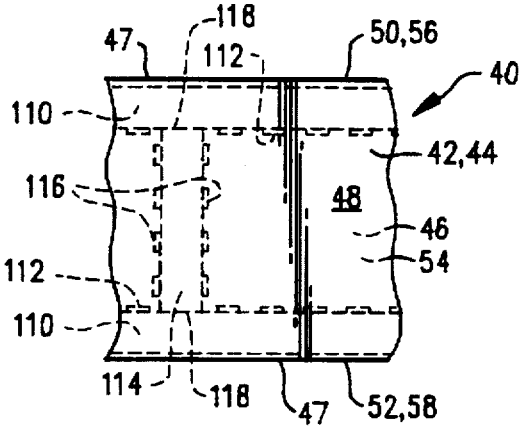
FIG. 20 is a side elevation view of the side of the fifth preferred embodiment shown in FIG. 15.

FIG. 15 is a perspective view of a fifth preferred embodiment of the thermally-insulative member of the present invention. FIG. 16 is a side elevation view of an end of the fifth preferred embodiment of the thermally-insulative member of the present invention, and FIG. 17 is a side elevation view of a side of the fifth preferred embodiment of the thermally-insulative member of the present invention. FIG. 18 is a top view of the end of the fifth preferred embodiment of the thermally-insulative member of the present invention, and FIG. 19 is a bottom view of the end of the fifth preferred embodiment of the thermally-insulative member of the present invention. FIG. 20 is a side elevation view of the side of the fifth preferred embodiment shown in FIG. 15.

The fifth preferred embodiment of the thermally-insulative member 40 of the present invention is substantially the same as the first preferred embodiment of the thermally-insulative member 40 shown in FIGS. 1–5. However, the fifth preferred embodiment shows a further way of increasing the strength of the member 40 by adding 12 gauge rectangular reinforcing tubes 110 which extend longitudinally within the corners of the channel load-supporting members 42 and 44. In some embodiments, the member 40 can include two tubes 110 placed adjacent the upper legs 50 and 56 of the load-supporting members 42 and 44. However, in other applications, four tubes 110 are desirable. The reinforcing tubes 110 are attached to the webs 48 and 54 and to the upper legs 50 and 56 and to the lower legs 52 and 58 by means of stitch welds 112. If still further reinforcement of the member 40 is desired, the two reinforcing tubes 110 that are built into one of the first and second load-bearing members 42 and 44 are joined with a vertical length 114 of rectangular tube. The vertical length 114 is attached to both the web 48 or 54 of the corresponding load-bearing member 42 and 44 by means of stitch welds 116. The vertical length 114 is also attached to both of the reinforcing tubes 110 by welds 118. The thermally-insulative member 46 has cutout portions cut or formed in those areas corresponding to the locations of the vertical lengths 114. Of course, the lengths 60 or 90 can be added to the member if still further strengthening is desired. If the lengths 60 or 90 are added, they are attached to the webs 48 and 54 by fasteners 62 and/or stitch welding.

Figure 22:
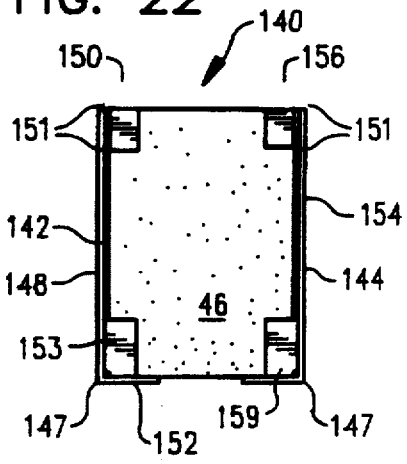
FIG. 22 is a side elevation view of an end of the sixth preferred embodiment of the thermally-insulative member of the present invention.
Figure 21:
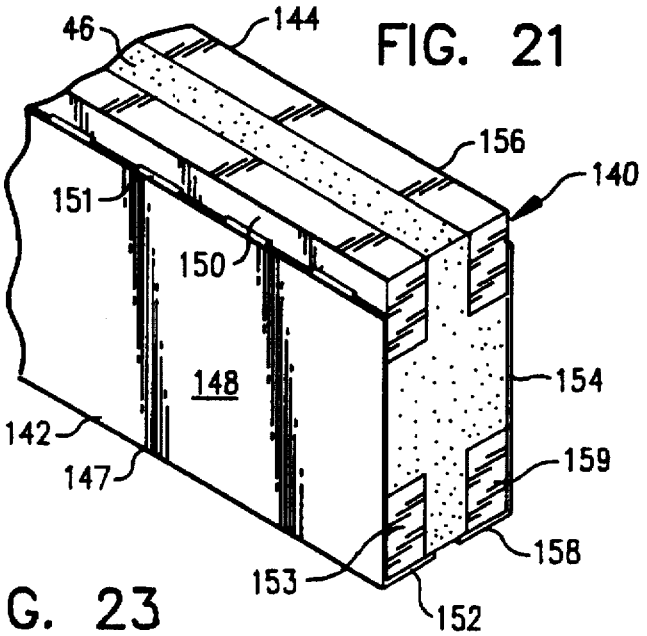
FIG. 21 is a perspective view of a sixth preferred embodiment of the thermally-insulative member of the present invention.
Figure 23:
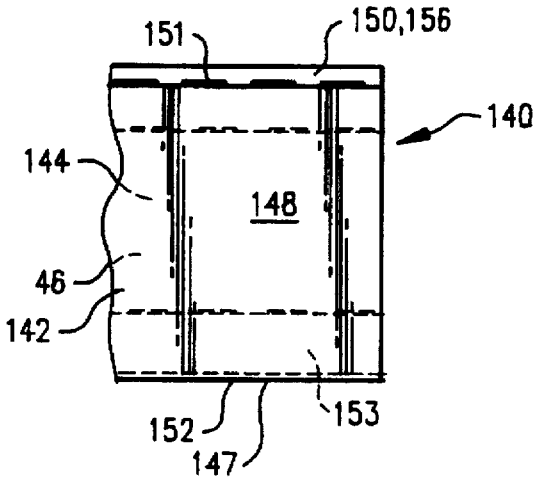
FIG. 23 is a side elevation view of a side of the sixth preferred embodiment of the thermally-insulative member of the present invention.
Figure 24:
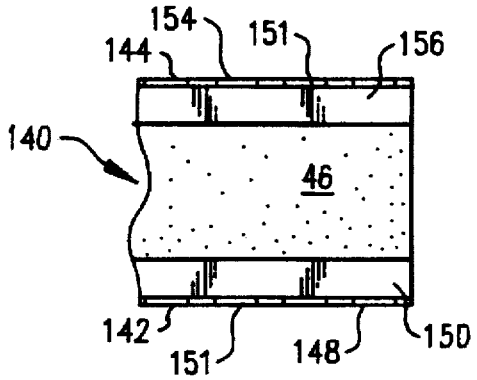
FIG. 24 is a top view of the end of the sixth preferred embodiment of the thermally-insulative member of the present invention.
Figure 25:
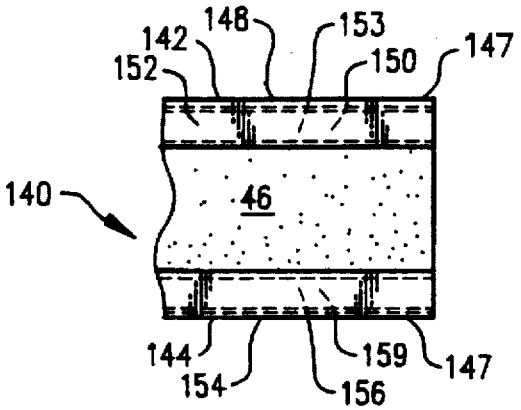
FIG. 25 is a bottom view of the end of the sixth preferred embodiment of the thermally-insulative member of the present invention.

FIG. 21 is a perspective view of a sixth preferred embodiment of the thermally-insulative member of the present invention. FIG. 22 is a side elevation view of an end of the sixth preferred embodiment of the thermally-insulative member of the present invention, and FIG. 23 is a side elevation view of a side of the sixth preferred embodiment of the thermally-insulative member of the present invention. FIG. 24 is a top view of the end of the sixth preferred embodiment of the thermally-insulative member of the present invention, and FIG. 25 is a bottom view of the end of the sixth preferred embodiment of the thermally-insulative member of the present invention.

The thermally insulative member 140 includes a first load-bearing member 142, a second load-bearing member 144, and a thermally-insulative member 46. The first and second load-bearing members 142 and 144 are each elongated and made from a single integral piece of material. If the material is a sheet metal, such as steel plate, galvanized steel or aluminum, the first and second load-bearing members 142 and 144 are formed by properly bending the sheet. A 16 gauge sheet metal has been found suitable for many applications, although other gauges can be chosen as desired. If the material is a formed material, such as fiberglass or carbon fiber composites, the first and second load-bearing members 142 and 144 are shaped properly before their shape is set by some further action, such as a thermal or chemical reaction.

The thermally-insulative member 46 is placed between and in contact with the first and second members 142 and 144. The placement is set so that the first and second members 142 and 144 each extend transversely, both vertically and horizontally, relative to the thermally-insulative member 46. The thermally-insulative member 46 is formed from any material having a suitable thermal insulation value. Preformed blocks made from expanded or extruded polystyrene are suitable, although polyethylene, polyisocyanurite and polyurethane are also suitable plastics. In the sixth preferred embodiment shown in FIGS. 21–25, the first and second members 142 and 144 are reinforced angles, formed by bending a length of 12 gauge galvanized sheet steel along a line 147. The first member 142 includes a web 148 that extends between an upper tube 150 (to which it is attached by stitch welding 151) and a lower leg 152. A lower tube 153 is welded to the first member where the web 148 meets the lower leg 152. The lower tube 153 is rectangular (being 1 inch in width and 2 inches in height) and made from 12 gauge steel. Similarly, the second member 142 includes a web 154 that extends between an upper tube 156 (to which it is attached by stitch welding 157) and a lower leg 158. A lower tube 159 is welded to the first member where the web 154 meets the lower leg 158. The lower tube 159 is rectangular (being 1 inch in width and 2 inches in height), and made from 12 gauge steel. The web 148 is parallel to the web 154, the lower legs 152 and 158 extend toward one another, and the four tubes 150, 153, 156 and 159 are parallel to one another.

The thermally-insulative member 46 is a rectangular solid having a length that is equal to the lengths of the first and second members 142 and 144. The height of the thermally-insulative member 46 is equal to the vertical separation from the tops of the upper tubes 150 and 156 to the lower legs 152 and 158, respectively. The width of the thermally-insulative member 46 is greater than the sum of the lower legs 152 and 158, so that the ends of the of the lower legs 152 and 158 do not touch. As a result, a portion of the thermally-insulative member 46 is exposed between the two upper tubes 150 and 156 and also between the two lower legs 152 and 158.

The first and second members 142 and 144 support the load applied to the member 140, and the thermally-insulative member 46 substantially increases the overall thermal insulation value of the member 140. The member 140 can be built in any desired dimensions. However, the vertical height of the member 140 is typically 8, 10 and 12 inches, while the width of the member 140 is typically 3.5 and 5.5 inches. The overall length of the member 140 is typically 30, 40, or more feet in trussing applications, and typically 3 to 8 feet in window and door header applications. Each of the upper tubes 150 and 156 is 1 inch wide and 2 inches in height, and each of the lower legs 152 and 158 is typically 1.5 inches long, although any suitable sizes can be chosen.

As additionally shown in FIG. 24, the member 140 can be further strengthened by the addition of vertical members 155 and diagonal members 157. The vertical members 155, which are spaced about every 2 feet, are welded to the webs 148 and 154 and to the tubes 150, 153,156 and 159. Further, the diagonal members 157 are welded to the webs 148 and 154, the tubes 150, 153, 156 and 159, and the vertical members 155 so that they act through the working points of the member 140, as would be known by those skilled in the art.

Figure 26:
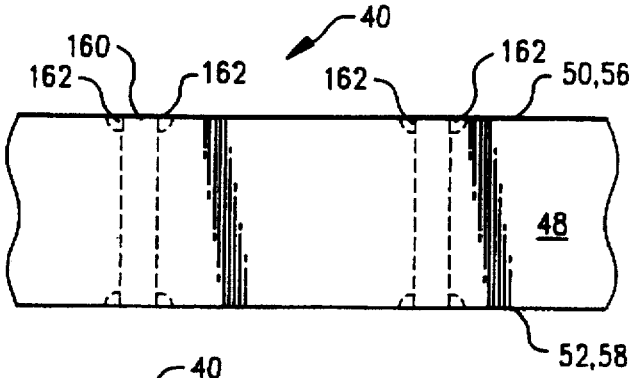
FIG. 26 is a side elevation view of a side of a seventh preferred embodiment of the thermally-insulative member of the present invention.
Figure 27:
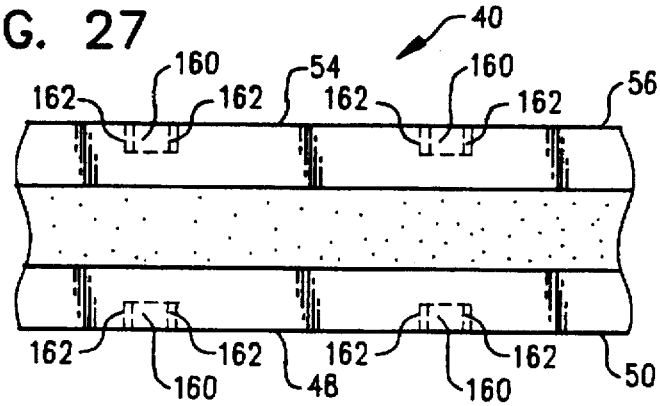
FIG. 27 is a top view of an end of the seventh preferred embodiment of the thermally-insulative member of the present invention.

FIG. 26 is a side elevation view of a side of a seventh preferred embodiment of the thermally-insulative member of the present invention and FIG. 27 is a top view of an end of the seventh preferred embodiment of the thermally-insulative member of the present invention. In the seventh preferred embodiment, where further reinforcement of the member 40 is desired, the two upper and lower legs 50 and 52 of the first load-supporting member 42 or the two upper and lower legs 56 and 58 of the second load-supporting member 44 are joined by 16 gauge rectangular reinforcing tubes 160. The reinforcing tubes 160 are attached to both the web 48 or 54 of the corresponding load-bearing member 42 and 44 and the legs 50 and 52 or 56 and 58 by means of stitch welds 162. The thermally-insulative member 46 has cutout portions cut or formed in those areas corresponding to the locations of the vertical lengths 160.

Figure 28:
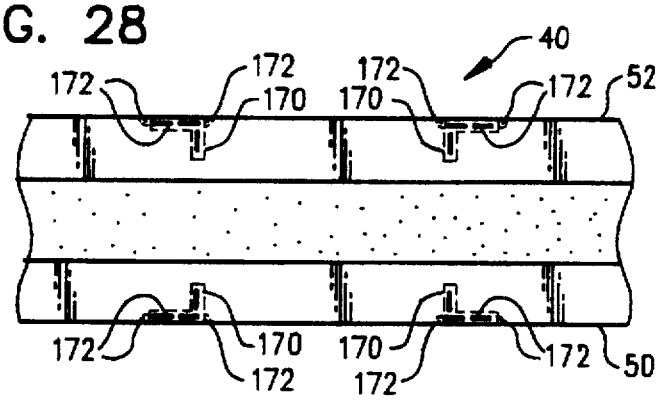
FIG. 28 is a top view of an end of an eighth preferred embodiment of the thermally-insulative member of the present invention.

FIG. 28 is a top view of an end of an eighth preferred embodiment of the thermally-insulative member of the present invention. In the eighth preferred embodiment, where additional reinforcement of the member 40 is desired, the two upper and lower legs 50 and 52 of the first load-supporting member 42 or the two upper and lower legs 56 and 58 of the second load-supporting member 44 are joined by 16 gauge reinforcing angles 170. The angles 170 are attached to both the web 48 or 54 of the corresponding load-bearing member 42 and 44 and the legs 50 and 52 or 56 and 58 by means of stitch welds 172. The thermally-insulative member 46 has cutout portions cut or formed in those areas corresponding to the locations of the vertical angles 170. The vertical angles 170 can be placed so that the bases of the angles 170 are oriented the same way (as shown in the lower portion of FIG. 28) or so that the bases of the angles are oriented oppositely (as shown in the upper portion of the FIG. 28).

Figure 29:
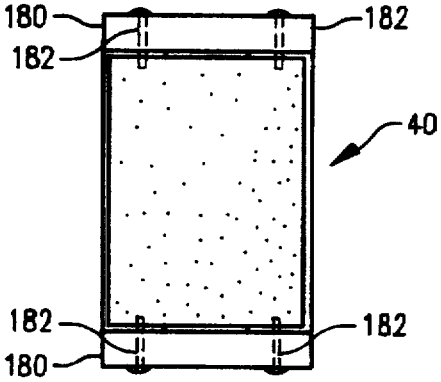
FIG. 29 is a side elevation view of the end of the first preferred embodiment of the thermally-insulative member of the present invention, showing modifications to the member suitable for use in certain types of construction.

FIG. 29 is a side elevation view of an end of the first preferred embodiment of the thermally-insulative member of the present invention, showing modifications to the member suitable for use in certain types of construction. In wood construction, it is frequently desirable to have upper and lower wooden plates 180. These are fastened to the upper and lower surfaces of the member 40 by means of fasteners 182 that pass through the wood plates 180 and into the upper legs 50 and 56 or the lower legs 52 and 58, respectively.

Figure 30:
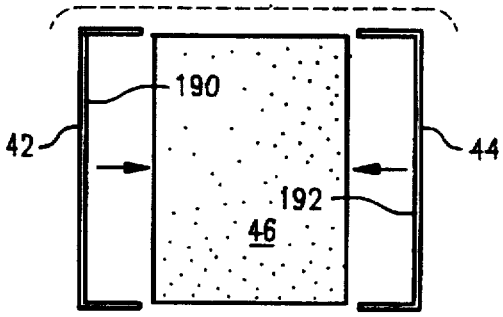
FIG. 30 is a schematic drawing of a first method for forming some of the preferred embodiments of the invention.

FIG. 30 is a schematic drawing of a first method for forming some of the preferred embodiments of the invention. In this method, the inner surfaces 190 and 192 of the respective first and second load-bearing members 42 and 44 are sprayed with an adhesive (such as a hot melt adhesive made by Reichhold Chemicals, Inc., of Downers Grove, Ill. and applied with equipment made by Slauterback Corp. of Sand City Calif.) and then the first and second load-bearing members 42 and 44 are forced over the thermally-insulative member 46 and held together until the adhesive is set up.

Figure 31:
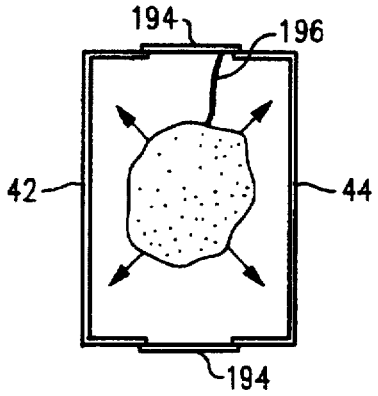
FIG. 31 is a schematic drawing of a second method for forming the various preferred embodiments of the invention.

FIG. 31 is a schematic drawing of a second method for forming the various preferred embodiments of the invention. In this method, the first and second load-bearing members 42 and 44 are held apart at the desired final distance by short straps 194, which are temporarily fastened to the upper and lower legs of the first and second load-bearing members 42 and 44. Thereafter, a conventional foam applicator 196 is placed between the first and second load-bearing members 42 and 44 and a volume of conventional expanding foam is released therefrom until the space between the first and second load-bearing members 42 and 44 is filled. After the foam has set up, the straps may be removed or, if desired, they may be left attached to the upper and lower legs 50, 56, and 52, 58.

Figure 32:
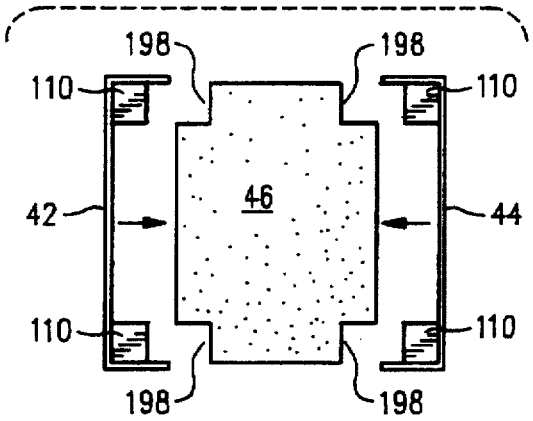
FIG. 32 is a schematic drawing of a third method for forming some of the preferred embodiments of the invention.

FIG. 32 is a schematic drawing of a third method for forming some of the preferred embodiments of the invention. In this third method, the thermally-insulative member 46 is shaped to fit against the first and second load-bearing members 42 and 44. Then, the inner surfaces 190 and 192 of the respective first and second load-bearing members 42 and 44 (including the upper and lower reinforcing tubes 110) are sprayed with an adhesive such as a hotmelt adhesive as described above in connection with FIG. 30. Then the first and second load-bearing members 42 and 44 are forced over the thermally-insulative member 46 (which has been prepared by the formation of cutouts 198 that have the same transverse dimensions as the upper and lower reinforcing tubes 110).

While the foregoing is a detailed description of the preferred embodiment of the invention, there are many alternative embodiments of the invention that would occur to those skilled in the art and which are within the scope of the present invention. Accordingly, the present invention is to be determined by the following claims.

I claim:

1. An elongated structural thermally-insulative element for supporting a load in a load-bearing direction that is transverse to the elongation, the element having two ends that are longitudinally displaced from one another, and comprising:

first and second integral elongated load-bearing members separated in a direction that is perpendicular to the load-bearing direction;

a thermally-insulative member placed between the first and second members so that the first and second members each extend in at least two transverse directions relative to the thermally-insulative member, thereby at least partially enclosing the thermally-insulative member without touching one another and forming a thermal break; and two transverse structural support members that are each placed in contact with at least one of the two load-bearing members and the thermally-insulative element.

2. The element of claim 1 wherein the two transverse structural support members are screwed or welded to both of the two load-bearing members and glued to the thermally-insulative element.

* * * * *